US008708201B2

(12) United States Patent
Shaw et al.

(10) Patent No.: US 8,708,201 B2
(45) Date of Patent: Apr. 29, 2014

(54) MODULAR PLATEN ASSEMBLY FOR INDUCTOR PUMP

(75) Inventors: Derek R. Shaw, Hopkins, MN (US); Paul R. Quam, Minneapolis, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 383 days.

(21) Appl. No.: 12/930,623

(22) Filed: Jan. 12, 2011

(65) Prior Publication Data

US 2012/0091145 A1 Apr. 19, 2012

Related U.S. Application Data

(60) Provisional application No. 61/294,331, filed on Jan. 12, 2010.

(51) Int. Cl.
*B67D 7/68* (2010.01)

(52) U.S. Cl.
USPC ..... 222/387; 222/262; 222/386; 222/405; 220/578

(58) Field of Classification Search
USPC ..... 222/256–262, 325–327, 386, 387, 392, 222/405, 389; 220/216, 227, 578, 580
See application file for complete search history.

(56) References Cited

U.S. PATENT DOCUMENTS

| | | | | |
|---|---|---|---|---|
| 2,545,531 | A * | 3/1951 | Sands | 141/357 |
| 2,630,248 | A | 3/1953 | Hinz | |
| 2,767,885 | A * | 10/1956 | Miller | 222/175 |
| 4,227,069 | A * | 10/1980 | Gardner et al. | 219/421 |
| 4,661,688 | A * | 4/1987 | Gabryszewski | 219/421 |
| 4,741,462 | A | 5/1988 | Schneider, Jr. | |
| 4,790,458 | A | 12/1988 | Moore | |
| 4,792,063 | A | 12/1988 | Moore | |
| 5,037,009 | A | 8/1991 | Shea | |
| 5,117,998 | A | 6/1992 | Handzel | |
| 5,361,940 | A | 11/1994 | Miller et al. | |
| 6,422,430 | B1 * | 7/2002 | Ito | 222/386 |
| 6,675,991 | B2 | 1/2004 | Johnson et al. | |

OTHER PUBLICATIONS

Graco Product Brochure, "Check-Mate ram package selection guide", pp. 1-16, printed Dec. 2010.
Graco Product Brochure, "Graco Supply Systems, Sealant & Adhesive Supply Systems with NXT™ Technology", pp. 1-12, © 2006, 2007.

* cited by examiner

*Primary Examiner* — J. Casimer Jacyna
(74) *Attorney, Agent, or Firm* — Kinney & Lange, P.A.

(57) ABSTRACT

A modular platen assembly comprises an annular hub, a wiper ring assembly and a coupling ring. The annular hub is for connecting to a ram of an inductor pump. The wiper ring assembly includes an annular wiper for sealing with a container. The coupling ring is independently joined to the hub and the wiper ring assembly at first and second connections, respectively.

21 Claims, 8 Drawing Sheets

MODULAR PLATEN ASSEMBLY FOR INDUCTOR PUMP

CROSS-REFERENCE TO RELATED APPLICATION(S)

This application claims priority under 35 U.S.C. §120 to U.S. provisional application Ser. No. 61/294,331, entitled "MODULAR PLATEN DESIGN," filed Jan. 12, 2010 by inventors Derek R. Shaw and Paul R. Quam, the contents of which are incorporated by this reference.

BACKGROUND

The present invention relates generally to inductor pumps for pumping highly viscous fluid from containers. In particular, the present invention relates to platens used to push the fluid from a drum or the like.

Inductor pumps typically comprise linear pneumatic actuators that force a pipe having a platen into a drum. The platen includes a central bore that leads to a passageway in the pipe. As the platen is lowered into the drum by the pneumatic actuators, the highly viscous fluid is forced into the central bore and up the passageway. The fluid is pushed into a pump that forces pressurized fluid through a hose into spray device where an operator can dispense a metered amount of fluid into some other typically smaller container. In order to ensure advantageous operation of the inductor pump and to reduce waste, it is desirable to provide adequate sealing between the platen and drum, to prevent leakage of the fluid out of the container. Platens include flexible wipers that deflect against the drum and form a seal. The flexible wipers are selected based on the type of fluid and the type of drum in which the fluid is stored. For example, more viscous fluids require stiffer wipers. Also, some fluids are stored in containers that have variable geometry that require longer wipers or multiple wipers. Furthermore, containers have various diameters that require platens of different sizes. Attempts have been made to design platens that can be used in a variety of containers. For example, U.S. Pat. No. 5,117,998 to Handzel, which is assigned to Graco Inc., discloses a universal platen that can be used in different wiper configurations when mounted to an inductor plate hub. However, such a universal platen must be completely disassembled at the hub to replace or reconfigure the wiper. As such, there is a need for a more easily configurable universal platen.

SUMMARY

The present invention is directed to a modular platen assembly for use with an inductor pump. The modular platen assembly comprises an annular hub, a wiper ring assembly and a coupling ring. The annular hub is for connecting to a ram of an inductor pump. The wiper ring assembly includes an annular wiper for sealing with a container. The coupling ring is independently joined to the hub and the wiper ring assembly at first and second connections, respectively.

DETAILED DESCRIPTION

Figure 1A:
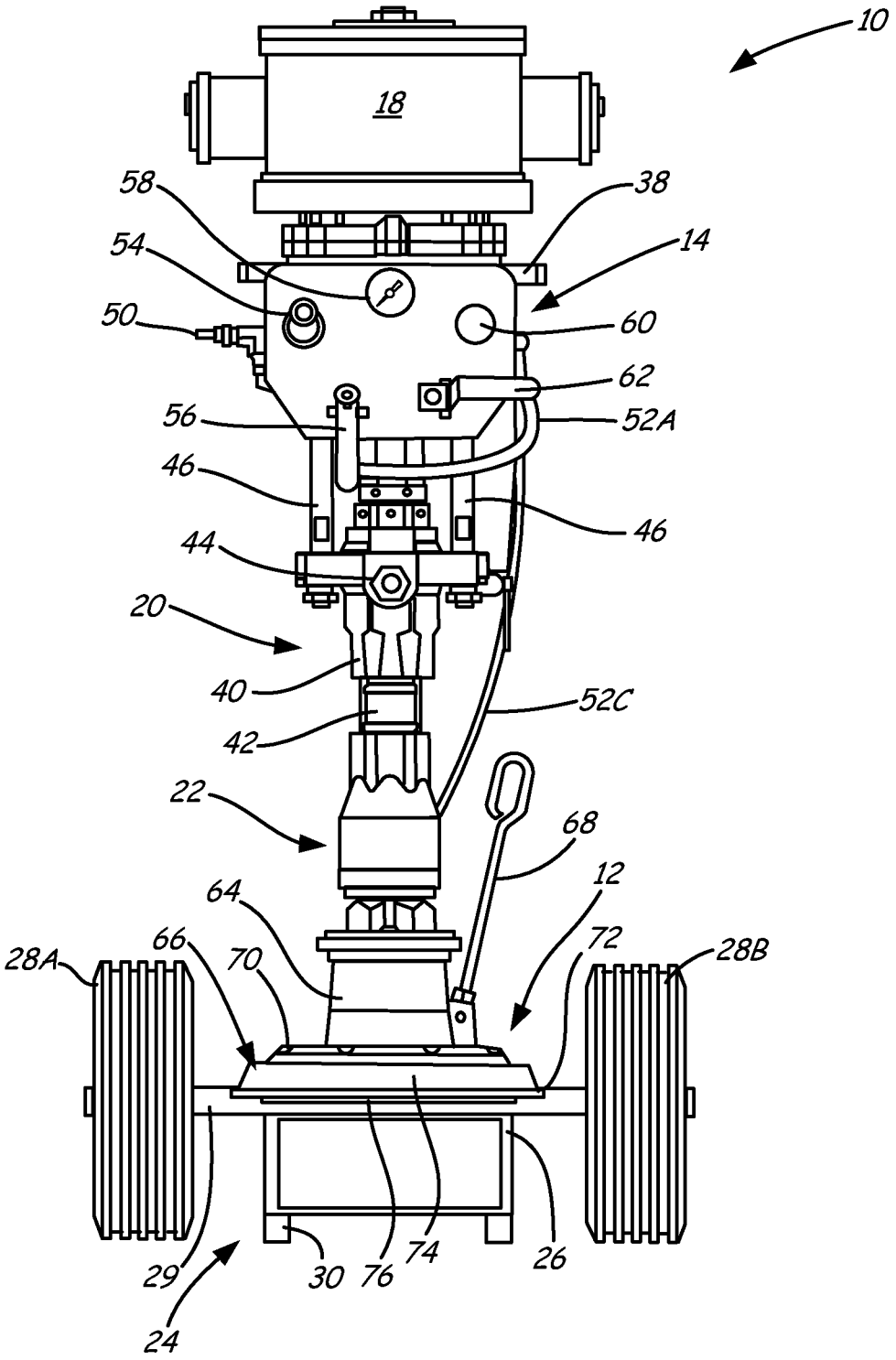
FIG. 1A is a front view of an inductor pump system having a modular platen assembly of the present invention.
Figure 1B:
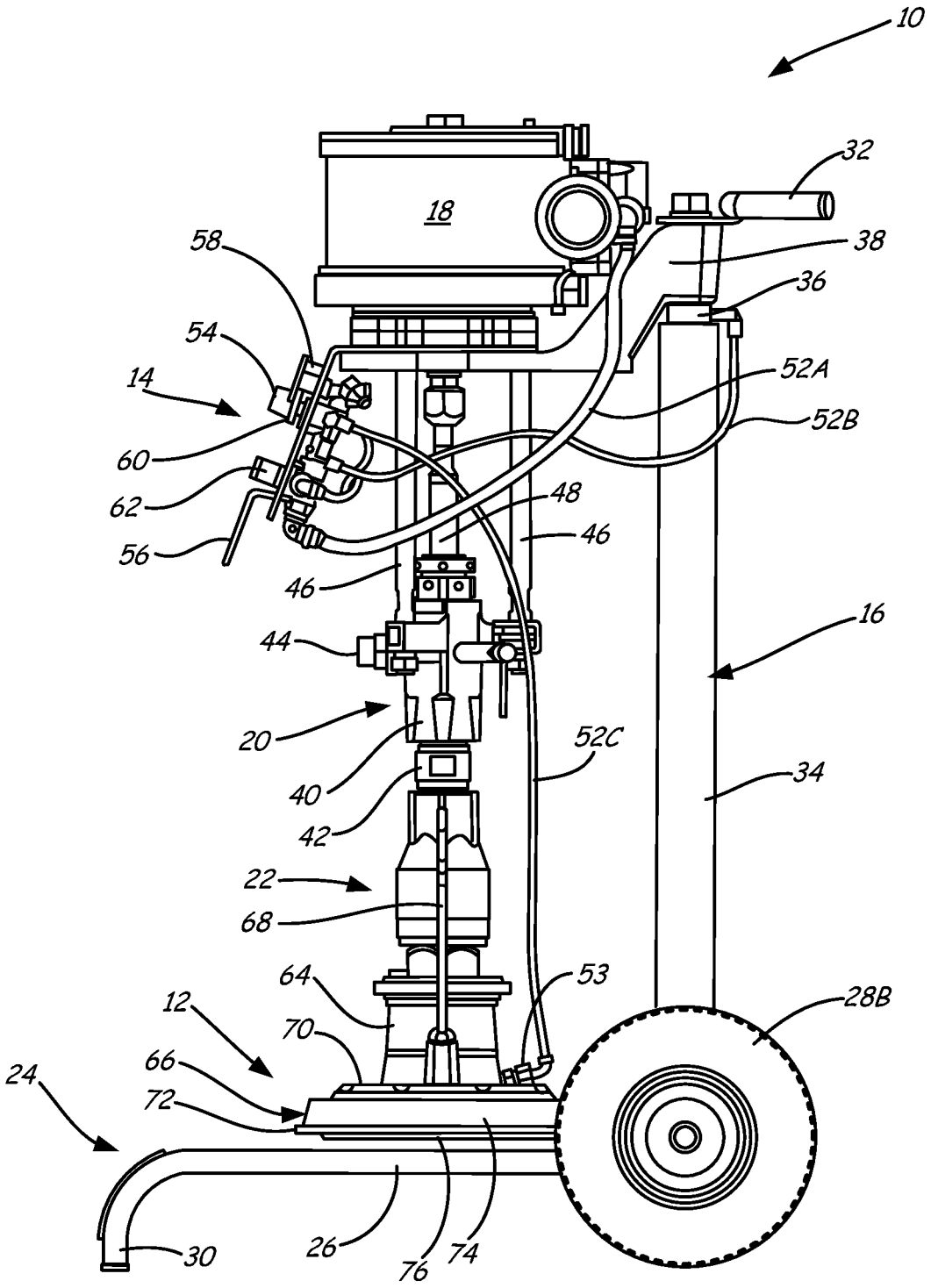
FIG. 1B is a side view of the inductor pump system having a modular platen assembly of FIG. 1A.

FIG. 1A is a front view of inductor pump system 10 having modular platen assembly 12 of the present invention. FIG. 1B is a side view of inductor pump system 10 having modular platen assembly 12 of FIG. 1A. FIGS. 1A and 1B are discussed concurrently. Inductor pump system 10 also includes elevator controls 14, ram 16 (FIG. 1B), air motor 18, pump 20 and ram pipe 22, all of which are carried by cart 24. Cart 24 comprises platform 26, wheels 28A and 28B, axle 29, kickstand 30 and handle 32. Ram 16 (FIG. 1B) includes cylinder 34, piston 36 and support bracket 38. Pump 20 includes housing 40, inlet 42, outlet 44 and mounting pins 46. Air motor 18 includes output shaft 48 (FIG. 1B). Elevator control module 14 includes inlet 50, outlet lines 52A and 52B (FIG. 1B), blow off line 52C, check valve 53 (FIG. 1B), pressure regulator 54, on/off valve 56, pressure gage 58, pushbutton valve 60 and relief valve 62. Modular platen assembly 12 includes hub 64, wiper ring assembly 66, bleed stick 68 and cover 70. Wiper ring assembly 66 includes wiper 72 and spacer 74.

A container of a fluid that is to be dispensed by system 10 is stored on platform 26 so that the container is accessible to modular platen assembly 12. Wheels 28A and 28B are mounted on axle 29, which is connected to platform 26. Platform 26 is maintained level by wheels 28A and 28B and kickstand 30. However, by tipping cart 24 backwards on wheels 28A and 28B, such as by tilting ram 16 using handle 32, cart 24 can be easily moved to different locations. Once at the desired location, a dispenser device connected to pump 20 at outlet 44 is used to meter fluid pushed from the container by ram 16 and modular platen assembly 12. Modular platen assembly 12 of the present invention can be easily removed and replaced or reconfigured to allow system 10 to be used with a variety of containers.

Figure 2A:
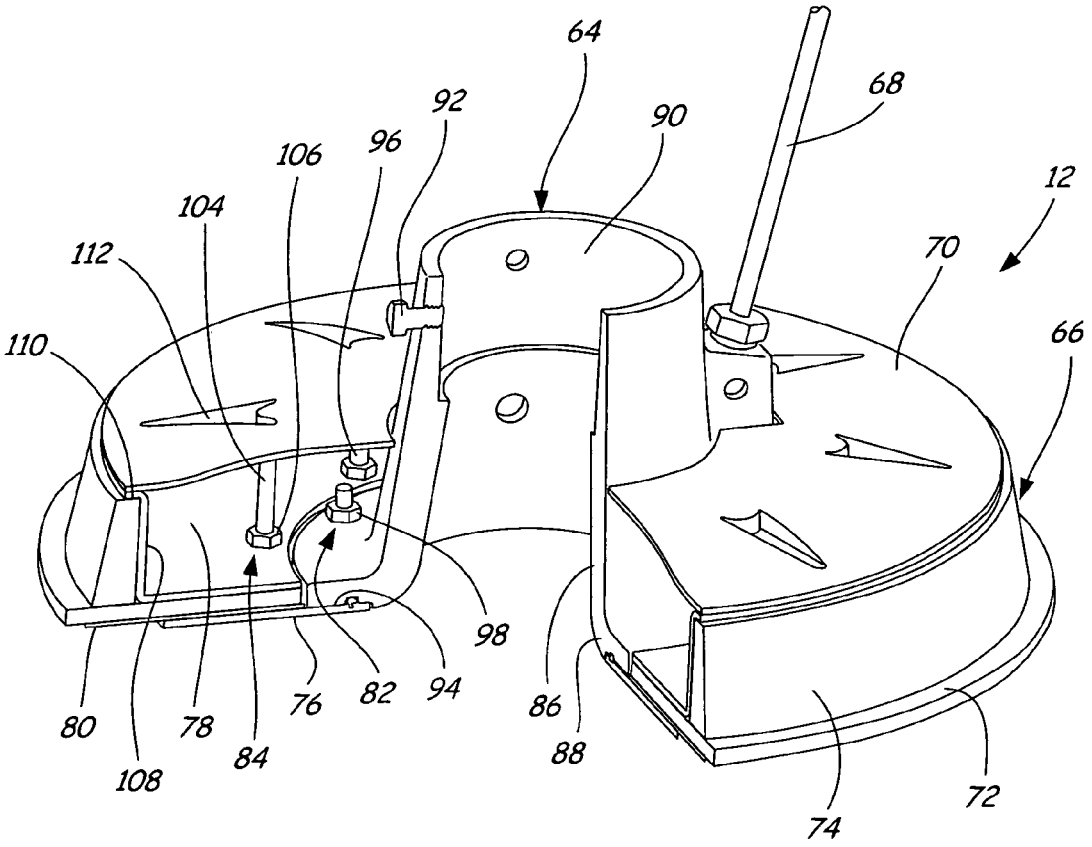
FIG. 2A is perspective view of the modular platen assembly of FIGS. 1A and 1B with a quarter section removed to show connection of a single wiper ring assembly with a hub.
Figure 2B:
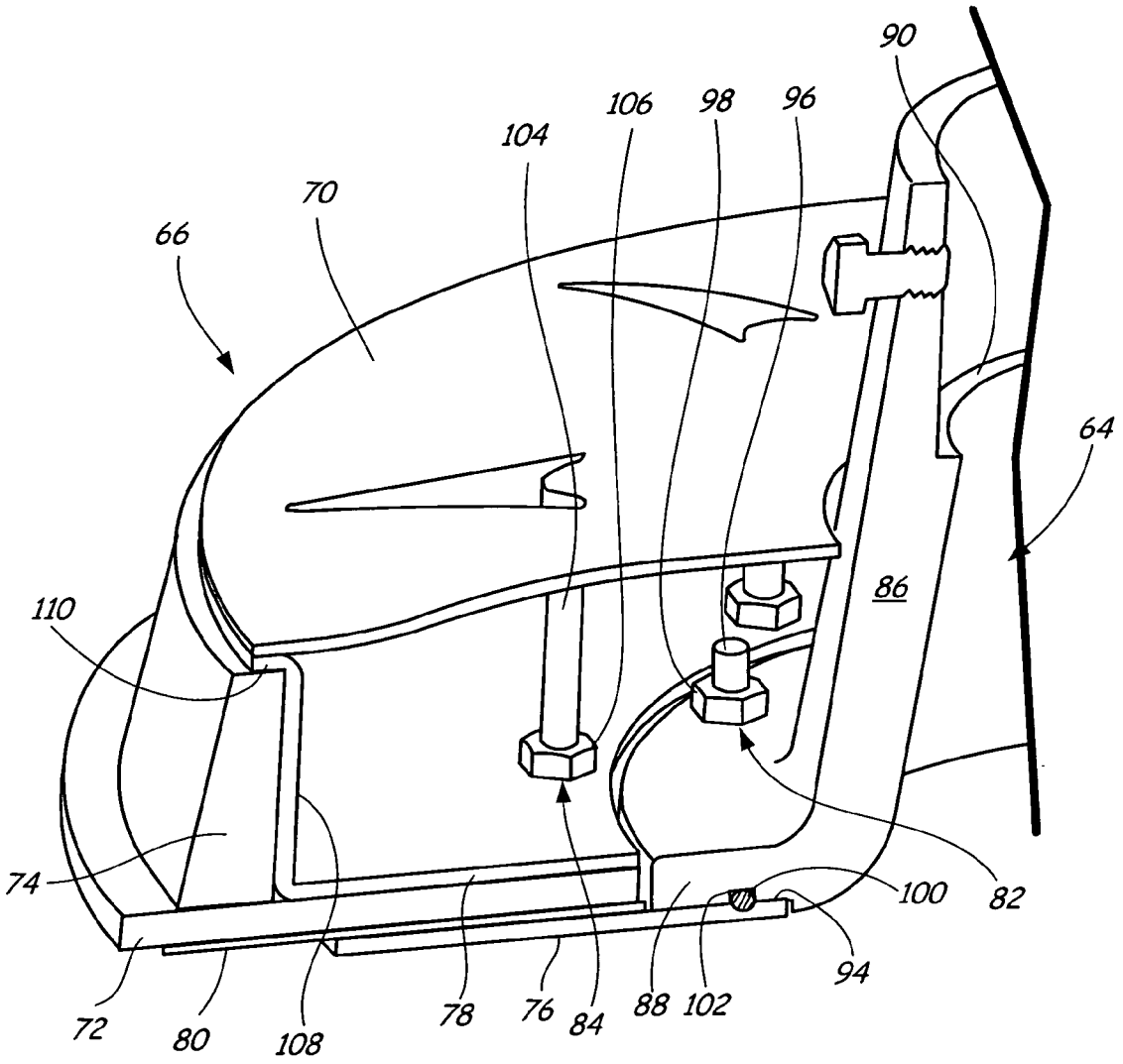
FIG. 2B is a close up view of the platen assembly of FIG. 2A showing a coupling ring joining the single wiper ring assembly to the hub.

Ram 16 comprises pneumatic cylinder 34 in which piston 36 is disposed. As shown in FIG. 1, piston 36 is fully seated within cylinder 34 of ram 16. Support bracket 38 is mounted to a top, exposed end of piston 36. Air motor 18 is mounted to the top of support bracket 38 and is controlled by elevator control 14, which is mounted to the front of support bracket 38. Pressurized air from a separate source (not shown) is provided to inlet 50 of elevator control 14. Air motor 18 receives a flow of pressurized air from elevator control 14 through line 52A. Cylinder 34 receives a flow of pressurized air from elevator control 14 through line 52B. Pump 20 is suspended from the bottom of support bracket 38 by pins 46 that connect to housing 40. Drive shaft 48 extends from air motor 18 to connect with pump 20. Ram pipe 22 connects to inlet 42 of pump 20 and a dispensing device (not shown) is connected to outlet 44 through a hose. Hub 64 of modular platen assembly 12 connects to ram pipe 22 and wiper ring assembly 66 connects to hub 64 using coupling ring 76, as shown in FIGS. 2A and 2B.

In operation, ram 16 is used to lift support bracket 38 up and away from platform 26 such that a container can be positioned between platform 26 and modular platen assembly 12. Specifically, on/off valve 56 is opened to supply pressurized air to inlet 50, relieving valve 62 is positioned to direct air to ram 16 by allowing air to enter line 52B. The pressurized air travels to the bottom of cylinder 34 through piston 36 and pushes piston 36 out of cylinder 34, pushing support bracket 36 away from platform 26. Subsequently, a container storing a viscous fluid is positioned on platform 26 below wiper ring assembly 66. Relieving valve 62 is repositioned to stop providing pressurized air to cylinder 34, allowing modular platen assembly 12 to fall into the container. The speed of travel of piston 36 is controlled by the rate at which air is permitted to leave cylinder 34 at a relief orifice in relieving valve 62. Additionally, the descent of modular platen assembly 12 can be paused by depressing pushbutton 60 while relieving valve 62 is closed to prevent air from reaching the relief valve in relieving valve 62 and leaving cylinder 34.

Wiper ring assembly 66 engages the side of the container to push the viscous fluid downward, which forces the fluid up into a central bore located in hub 64 such that the fluid travels into ram pipe 22 and to pump 20. On/off valve 56 is positioned to permit pressurized air to flow to air motor 18, which causes air motor 18 to actuate drive shaft 48. Depending on the type of pump used, drive shaft 48 rotates or reciprocates to drive pump 20. Pump 20 pressurizes the fluid provided by ram pipe 22 and distributes the pressurized fluid to outlet 44 whereby the dispensing device can be used to meter measured amounts of the fluid. As fluid from the container is consumed, modular platen assembly 12 falls to the bottom of the container.

To remove modular platen assembly 12 from the container, relieving valve 62 is again positioned to allow pressurized air to flow into cylinder 34. Pushbutton valve 60 is also toggled to alternatively direct air from elevator control 14 to line 52C, which delivers pressurized air into the container through modular platen assembly 12 to prevent a vacuum from forming in the container and to help push wiper ring assembly 66 out of the container. Check valve 53 prevents flow of air from the container into valve 60 or cylinder 34. Additionally, bleed stick 68 can be manually actuated to allow airflow into and out of the container through a valve in hub 64. Further description of the operation of elevator control 14 is located in a related application having Ser. No. 12/930,637 and entitled "ELEVATOR CONTROL FOR INDUCTOR PUMP," which is filed on the same day as this application and is incorporated herein by reference.

As modular platen assembly 12 descends into the container, wiper 72 deflects to engage the sidewalls of the container to seal and scrape against the container. Containers comprise many different configurations, such as the diameter of the sidewalls, the slope of the sidewalls, and the presence or not of ribbing, corrugations or other stiffening features in the sidewalls. Wiper 72 and spacer 74 are not optimally configured to engage all containers. Modular platen assembly 12 of the present invention permits wiper ring assembly 66 and coupling ring 76 to be expediently removed from hub 64 without having to disassembly wiper 72 and spacer 74. As such, other wiper ring assemblies with different spacer and wiper configurations can be quickly secured to hub 64 for use with other containers. Or, if need be, wiper ring assembly 66 and coupling ring 76 can be removed from hub 64 and moved to a convenient location for disassembly and reconfiguration of wiper 72 and spacer 74 without having to move system 10 or remove hub 64.

FIG. 2A is perspective view of modular platen assembly 12 of FIGS. 1A and 1B with a quarter section removed to show connection of wiper ring assembly 66 with hub 64. FIG. 2B is a close up view of a portion of FIG. 2A showing coupling ring 76 joining wiper ring assembly 66 to hub 64. FIGS. 2A and 2B are discussed concurrently. In the embodiment of FIGS. 2A and 2B, modular platen assembly 12 comprises a single wiper platen. Modular platen assembly 12 can be assembled in other configurations, such as a dual wiper platen, as is discussed with reference to FIGS. 3A-3C. Modular platen assembly 12 includes hub 64, wiper ring assembly 66, bleed stick 68, cover 70, coupling ring 76, first connection 82 and second connection 84. Wiper ring assembly 66 includes wiper 72, spacer 74, wiper plate 78 and secondary wiper 80.

Hub 64 comprises axial collar 86 and radial flange 88. Collar 86 includes furrow 90 into which ram pipe 22 fits. Fasteners 92 secure ram pipe 22 to hub 64. Axial collar 86 forms a central passageway into which fluid from a container is pushed by wiper ring assembly 6. Radial flange 88 extends radially from a lower or bottom end of axial collar 86. As such, collar 86 extends axially outward and away from flange 88 with reference to the depicted embodiments of FIGS. 2A-2C. In various embodiments, hub 64 is made of carbon steel or stainless steel. Hub 64 typically comprises a thick casting and is thus a very heavy component. Wiper ring assembly 66 can be removed from hub 64 such that changes and maintenance can be performed without having to handle or transport hub 64, as was required in prior art configurations.

As is shown in FIG. 2B, flange 88 includes furrow 94 into which coupling ring 76 fits. First connection 82 secures coupling ring 76 to flange 88. In the embodiment shown, connection 82 comprises an array of fasteners 96 that extend from coupling ring 76 through mating holes in flange 88. Nuts 98 secure coupling ring 76 to flange 88. In one embodiment, fasteners 96 comprise threaded studs welded to an axially outward facing surface of coupling ring 76. In another embodiment, fasteners 96 comprise bolts that extend through openings in coupling ring 76 and are held in place by nuts 98 or some other fasteners such as a pins passing through fasteners 96. In various embodiments, coupling ring 76 is made of carbon steel or stainless steel. Seal 100 is positioned between flange 88 and coupling ring 76 to prevent fluid from passing therebetween. Channel 102 extends into furrow 94 to provide a seat for seal 100. In one embodiment, seal 100 comprises a rubber O-ring.

Coupling ring 76 is secured to flange 88 such that a radially inner portion is adjacent flange 88 and a radially outer portion extends radially beyond flange 88. Second connection 84 joins coupling ring 76 to wiper ring assembly 66. In the embodiment shown, second connection 84 comprises an array of fasteners 104 that extend from coupling ring 76. Fasteners 104 are mounted to the radially outer portion of coupling ring 76, such as at a welded connection or via a bolted connection. Fasteners 104 extend through axially aligned holes in the various components of wiper ring assembly 66. As such, nuts 106 secure wiper ring assembly 66 to coupling ring 76 and maintain wiper ring assembly 66 assembled together.

Secondary wiper 80 is positioned on top of, or axially outward of, coupling ring 76. Secondary wiper 80 extends radially outward beyond the radially outer edge of coupling ring 76. In the embodiment shown, secondary wiper 80 has a larger diameter than coupling ring 76. Wiper 72 is positioned on top of, or axially outward of, secondary wiper 80. Wiper 72 extends radially outward beyond the radially outer edge of secondary wiper 80. In the embodiment shown, wiper 72 has a larger diameter than secondary wiper 80. Wiper 72 and secondary wiper 80 are made of a flexible and resilient material, such as silicone, polytetrafluoroethylene (PTFE), rubber or polyurethane. Secondary wiper 80 protects wiper 72 from exposure to fluids within the container in which modular platen assembly 12 is inserted.

Wiper plate 78 is positioned on top of, or axially outward of, wiper 72. Wiper plate 78 extends radially outward beyond the radially outer edge of coupling ring 76. In the embodiment shown, wiper plate 78 has a larger diameter than coupling ring 76. The radially outer end of wiper plate 78 is shaped to engage and secure spacer 74. In particular, wiper plate 78 includes axially extending wall 108 and radially extending flange 110. Secondary wiper 80, wiper 72 and wiper plate 78 are axially stacked adjacent, or radially aligned with, flange 86 such that a seam is formed between hub 64 and wiper ring assembly 66.

Spacer 74 is positioned on top of, or axially outward of, a radially outer portion of wiper 72. Spacer 74 comprises a resilient block of material that allows wiper 72 to deflect against sidewalls of the container in which modular platen assembly 12 is used. In one embodiment, spacer 74 is comprised of a polyurethane elastomer. In the embodiment shown, spacer 74 includes a first end surface that engages wiper 72, a second end surface that engages flange 110 of wiper plate 78. Also, spacer 74 includes a first side surface that engages wall 108 of wiper plate 78 and a second side surface that extends at an oblique angle between the first and second end surfaces. In the embodiment shown, the second side surface is sloped radially inward as it extends from wiper 72 to wiper plate 78. The slope of the second side wall affects the stiffness of wiper 72. For example, the further radially outward spacer 74 extends at the first end surface, the stiffer wiper 72 becomes. As such, spacer 74 can be flipped over such that the second side surface is sloped radially outward as it extends from wiper 72 to wiper plate 78 to lessen the stiffness of wiper 72.

Cover 70 is positioned at the axially outward end of modular platen assembly 12 between wiper ring assembly 66 and hub 64. Cover 70 comprises a lid that prevents fluid from the container in which modular platen assembly 12 is disposed from falling into the space between spacer 74 and hub 64. Cover 70 rests on flange 110 of wiper plate 78 and on the tops, or axially outer ends, of fasteners 104. Cover 70 includes ports 112 that receive tips of fasteners 104. Some of ports 112 include windows that permit access to fasteners 104 from the outside of cover 70 such that cover 70 can be secured to fasteners 104. Cover 70 can, however, be configured to connect to assembly 12 in other ways, such as by catches located within ports 112.

Figure 2C:
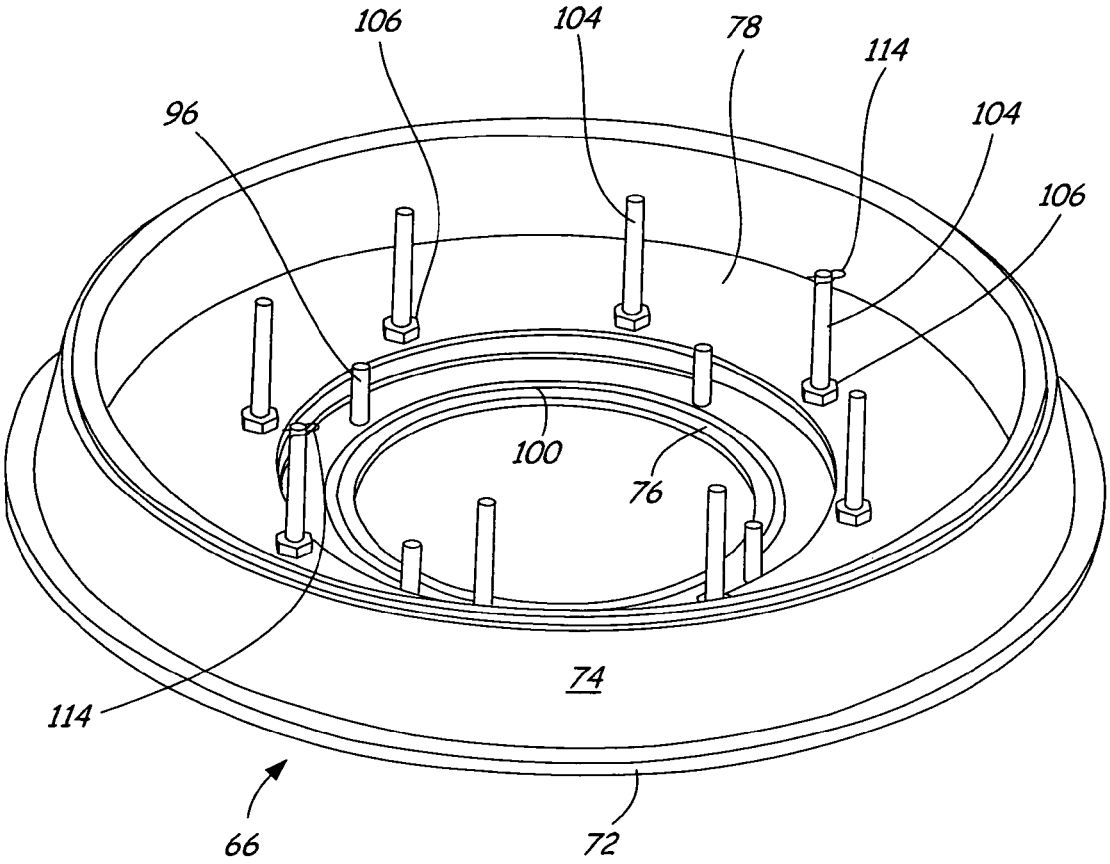
FIG. 2C is a full perspective view of the single wiper ring assembly of FIGS. 2A and 2B as removed from the hub.

FIG. 2C is a full perspective view of wiper ring assembly 66 of FIGS. 2A and 2B as removed from hub 64 and without cover 70. Cover 70 is retained in connection with wiper ring assembly 66 via pins 114. With cover 70 in position on the outer ends of fasteners 104, pins 114 are inserted through windows in ports 112 (FIG. 2B) and into recesses or grooves within fasteners 104. Pins 114 are pulled from the recesses or grooves back through ports 112 so that cover 70 can be removed from wiper ring assembly 66. With cover 70 removed, nuts 98 are removed from fasteners 96 such that wiper ring assembly 66 and coupling ring 76 can be pulled from flange 88 of hub 64. As such, wiper ring assembly 66 and coupling ring 76 comprise a modular platen assembly that can be easily removed from hub 64 without having to disassemble wiper 72, spacer 74 and secondary wiper 80. If wiper ring assembly 66 needs to be taken apart, such as to reverse spacer 74, disassembly and reassembly can be completed in a convenient setting while hub 64 is still attached to ram pipe 22 (FIGS. 1A and 1B). Assembled wiper ring assemblies can thus be independently assembled before coupling to hub 64, making the process more convenient and expedient. Other wiper ring assemblies can be secured to hub 64 for use with different containers.

Figure 3A:
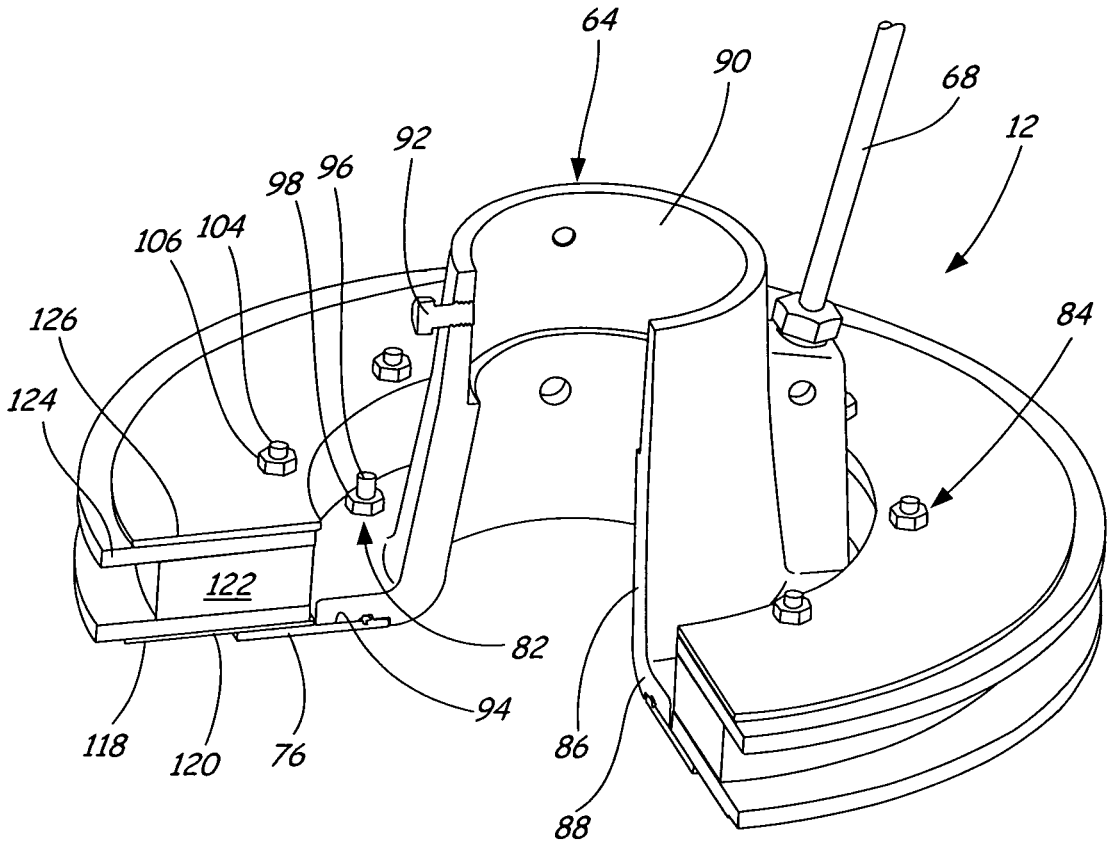
FIG. 3A is a perspective view of a second embodiment of a modular platen assembly with a quarter section removed to show connection of a dual wiper ring assembly with a hub.
Figure 3B:
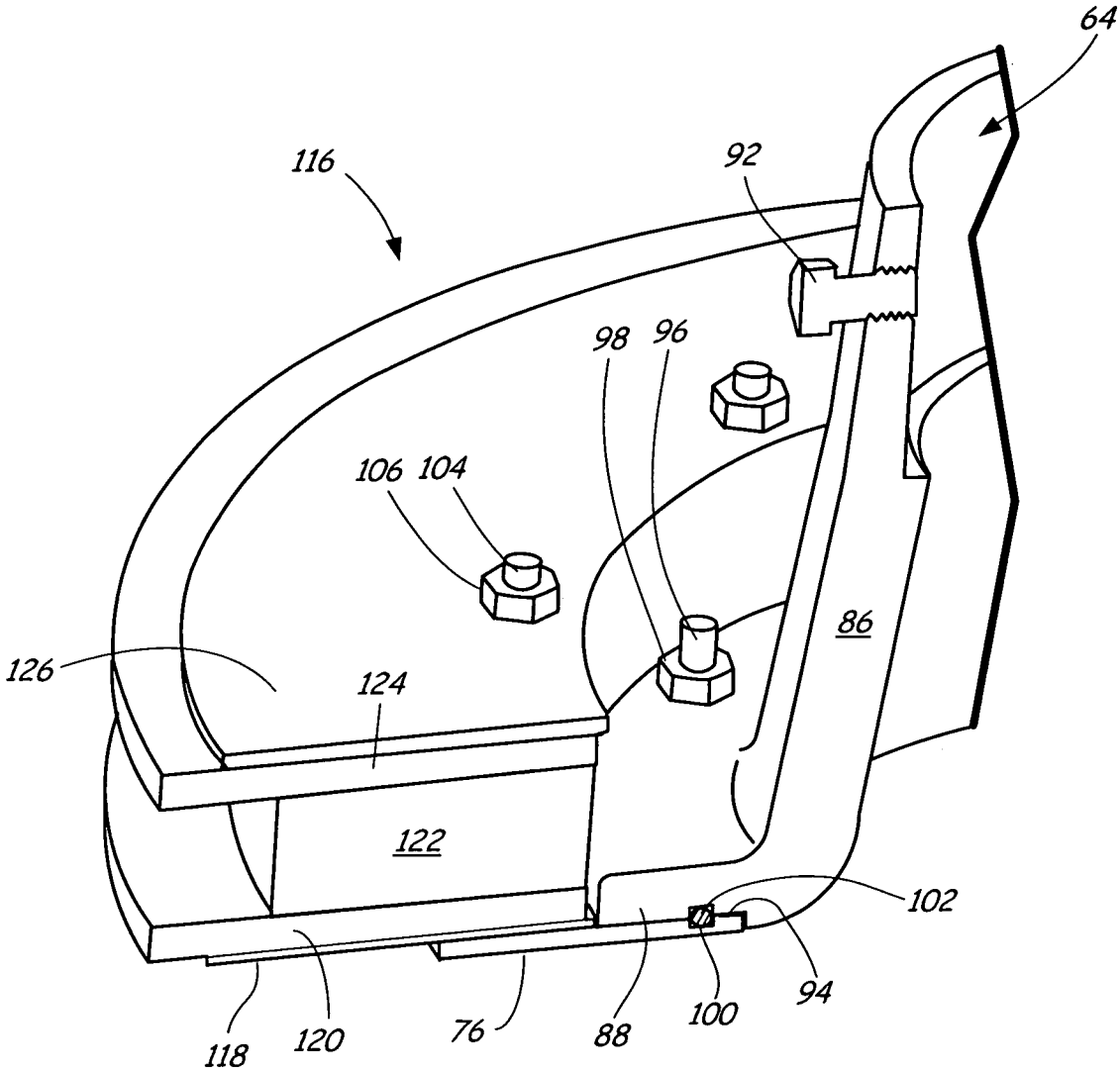
FIG. 3B is a close up view of the platen assembly of FIG. 3A showing a coupling ring joining the dual wiper ring assembly to the hub.
Figure 3C:
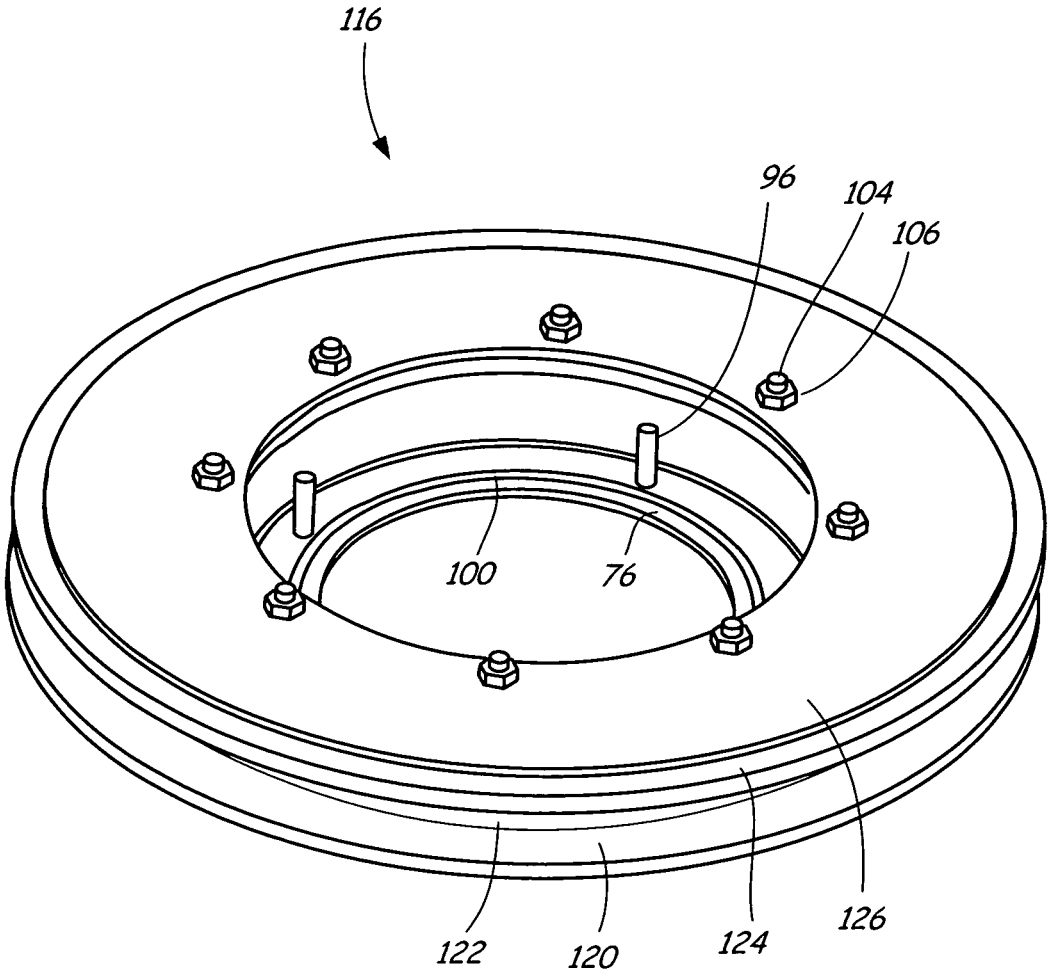
FIG. 3C is a full perspective view of the dual wiper ring assembly of FIGS. 3A and 3B as removed from the hub.

FIG. 3A is a perspective view of a second embodiment of modular platen assembly 12 with a portion removed to show connection of wiper ring assembly 116 with hub 64. FIG. 3B is a close up view of the quarter section of FIG. 3A showing coupling ring 76 joining wiper ring assembly 116 to hub 64. FIG. 3C is a full perspective view of wiper ring assembly 116 of FIGS. 3A and 3B as removed from hub 64. FIGS. 3A-3C are discussed concurrently. In the embodiment of FIGS. 3A-3C, modular platen assembly 12 comprises a dual wiper platen.

Hub 64 and coupling ring 76 comprise elements as discussed with reference to FIGS. 2A-2C and are joined in a like manner using fasteners 96 and nuts 98. Seal 100 is positioned between an inner diameter portion of coupling ring 76 and flange 88, and an outer diameter portion of coupling ring 76 extends radially beyond flange 88 for coupling with wiper ring assembly 116. Fasteners 104 extend axially from coupling ring 76 and provide posts upon which wiper ring assembly 116 can be built, as with wiper ring assembly 66. Wiper ring assembly 116 includes first secondary wiper 118, first wiper 120, spacer 122, second wiper 124 and second secondary wiper 126, which are all stacked upon each other on fasteners 104 and secured with nuts 106.

Secondary wipers 118 and 126 are similar to that of secondary wiper 80 of FIG. 2B and are made of similar materials to perform the same function. First wiper 120 and second wiper 124 are similar to that of wiper 72 of FIG. 2B and are made of similar materials to perform the same function. A cover such as cover 70 can be coupled to fasteners 104 as is shown and discussed with reference to FIGS. 2B and 2C.

Spacer 122 is made of similar materials as spacer 74 of FIG. 2B. Spacer 122 is, however, shaped to affect the performance of first wiper 120 and second wiper 124 equally. Spacer 122 comprises a block of resilient material that is positioned between first wiper 120 and second wiper 124 to determine the effective stiffness of the wipers. As with spacer 74, the radial width of spacer 122 determines how much of wipers 120 and 124 is free to deflect against the sidewalls of the container. Spacer 122 includes two side surfaces that extend between two equally wide end surfaces in generally straight axial directions such that spacer 122 comprises a rectangular cross-section. Spacer 122 thus affects the rigidity of wipers 120 and 124 equally. The diameter of spacer 122 can be changed in different embodiments to change the stiffness of the wipers. For example, the diameter of spacer 122 can be increased to stiffen wipers 120 and 124 for use with more viscous fluids.

The dual wiper configuration of wiper ring assembly 116 is advantageously used in storage containers having annular stiffening corrugations on the sidewalls. For example, with wiper ring assembly 116 inserted into a container, first wiper 120 and second wiper 124 are deflected against the container sidewall. As wiper ring assembly 116 is withdrawn upward and outward from a container, second wiper 124 will initially engage a corrugation in the sidewall and become less deflected or completely straighten out. First wiper 120 will, however, remain engaged with the sidewall to maintain a seal. As second wiper 124 disengages the corrugation and deflects to produce a seal, first wiper 120 will engage the corrugation and straighten out. Thus, the at least one wiper is always in engagement with the sidewall to maintain a seal at all times. The height of spacer 122 can be changed in different embodiments for containers having corrugations of different axial heights.

Wiper ring assembly 116 is an example of alternative embodiments of modular platen assembly 66 that can be used with the present invention. Wiper ring assemblies having different components and configurations can be made for use with coupling ring 76 and hub 64 of the present invention. For example, wiper ring assemblies can be configured with different platen and wiper diameters, different wiper stiffnesses, different spacer shapes, different numbers of wipers, different materials, etc. The wiper ring assemblies are easily mounted to coupling ring 76 and secured with fasteners to provide a modular assembly that can be easily assembled with and removed from hub 64 without having to disassemble the individual wipers, secondary wipers and spacers of the wiper ring assembly. When disassembly of individual components is desired, the wiper ring assembly can be removed from hub 64. As such, alterations and repairs of system 10 can be more rapidly and easily conducted.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A modular platen assembly for use with a variety of containers, the modular platen assembly comprising:
- a hub comprising:
  - an axial collar for connecting to a ram of an inductor pump; and
  - a radial flange extending from the axial collar;
- a coupling ring connected to the radial flange on a surface facing axially away from the axial collar at a first connection and extending radially outward beyond the radial flange;
- a wiper ring assembly connected to the coupling ring on a surface facing axially toward the axial collar at a second connection independent of the first connection, the wiper ring assembly comprising:
  - a wiper connected to the coupling ring at the second connection; and
- a cover coupled to the hub and the wiper ring assembly to cover the first connection and the second connection.

2. The modular platen assembly of claim 1 wherein the second connection is radially outward of the first connection.

3. The modular platen assembly of claim 1 wherein the first and second connections comprise arrays of fasteners extending from the coupling ring and through the radial flange and the wiper ring assembly, respectively.

4. The modular platen assembly of claim 3 and further comprising:
- holes disposed in the cover such that at least some of the fasteners of either the first connection or the second connection extend through the holes; and
- retainer pins extending through the fasteners extending through the holes to retain the cover.

5. The modular platen assembly of claim 1 and further comprising a seal positioned axially between the coupling ring and the radial flange, the seal being partially recessed into a groove extending along the radial flange.

6. The modular platen assembly of claim 1 wherein the radial flange includes a furrow such that the coupling ring can be recessed into the hub.

7. The modular platen assembly of claim 1 wherein the wiper ring assembly and the radial flange are radially aligned to form a seam such that the wiper ring assembly circumscribes the radial flange.

8. The modular platen assembly of claim 7 wherein the radial flange is positioned axially between the coupling ring and the collar.

9. The modular platen assembly of claim 1 wherein the wiper ring assembly further comprises:
- a wiper plate coupled to the coupling ring at the second connection, wherein the wiper is positioned axially between the wiper plate and the coupling ring.

10. The modular platen assembly of claim 9 wherein the wiper ring assembly further comprises:
- a spacer of deformable material positioned axially between the wiper and the wiper plate.

11. The modular platen assembly of claim 10 wherein the spacer comprises:
- a first end surface engaging the wiper;
- a second end surface engaging the wiper plate; and
- a radially outer surface extending between the first and second end surfaces at an oblique angle.

12. The modular platen assembly of claim 10 wherein the wiper ring assembly further comprises:
- a secondary wiper positioned axially between the wiper and the coupling ring, the secondary wiper having an outer radial end positioned between an outer radial end of the wiper and an outer radial end of the coupling ring.

13. The modular platen assembly of claim 1 wherein the wiper ring assembly further comprises:
- a second wiper; and
- a spacer positioned axially between the second wiper and the wiper connected to the coupling ring.

14. A modular platen assembly comprising:
- an annular hub for connecting to a ram of an inductor pump;
- a wiper ring assembly including an annular wiper for sealing with a container;
- a coupling ring independently joined to the hub and the wiper ring assembly at first and second connections, respectively;
- a wiper plate coupled to the coupling ring at the second connection, wherein the annular wiper is positioned axially between the wiper plate and the coupling ring; and
- a spacer of deformable material positioned between the annular wiper and the wiper plate;
- wherein the spacer of deformable material is retained against the wiper by the wiper plate; and
- the wiper ring assembly further comprises:
  - a secondary wiper positioned axially between the annular wiper and the coupling ring, the secondary wiper having an outer radial end positioned between an outer radial end of the wiper and an outer radial end of the coupling ring.

15. The modular platen assembly of claim 14 wherein:
- the hub includes a radially extending flange having an array of holes;
- the coupling ring comprises:
  - an inner diameter portion; and
  - an outer diameter portion;

the first connection comprises a first array of fasteners extending axially from the inner diameter portion and through the array of holes; and the second connection comprises a second array of fasteners extending axially from the outer diameter portion.

16. The modular platen assembly of claim 15 and further comprising:

a furrow extending along an outer diameter of the radially extending flange in which the inner diameter portion of the coupling ring sits; and a seal disposed within a groove on the furrow and between the radially extending flange and the inner diameter portion of the coupling ring.

17. The modular platen assembly of claim 15 and further comprising:

a cover extending between the wiper ring assembly and the annular hub to cover the first connection and the second connection;

a plurality of holes disposed in the cover such that at least some of the fasteners of the second connection extend through the holes; and retainer pins extending through the fasteners extending through the holes to retain the cover.

18. A modular platen assembly comprising:

a hub comprising:

an axial collar for connecting to a ram of an inductor pump and including a central passageway;

a radial flange extending from the axial collar, the radial flange including a plurality of holes;

a furrow extending along an outer diameter of the radial flange; and a groove located in the furrow;

a coupling ring comprising:

an inner diameter portion positioned in the furrow; and an outer diameter portion;

a first array of fasteners extending axially from the inner diameter portion and through the array of holes;

a second array of fasteners extending axially from the outer diameter portion;

a seal disposed within the groove; and an annular wiper ring assembly connected to the coupling ring at the second array of fasteners.

19. The modular platen assembly of claim 18 wherein the annular wiper ring assembly comprises:

a spacer of deformable material;

a first wiper proximate a first side of the spacer; and a second wiper proximate a second side of the spacer;

wherein the spacer, the first wiper and the second wiper are connected to the second array of fasteners.

20. A modular platen assembly comprising:

a hub comprising:

an axial collar for connecting to a ram of an inductor pump and including a central passageway; and a radial flange extending from the axial collar, the radial flange including a plurality of holes;

a coupling ring comprising:

an inner diameter portion; and an outer diameter portion;

a first array of fasteners extending axially from the inner diameter portion and through the array of holes;

a second array of fasteners extending axially from the outer diameter portion;

an annular wiper ring assembly connected to the coupling ring at the second array of fasteners;

a cover extending between the hub and the annular wiper ring assembly to cover the first array of fasteners and the second array of fasteners;

a hole disposed in the cover such that a fastener from the first array of fasteners or the second array of fasteners extends through the hole; and a retainer pin extending through the fastener that extends through the hole to retain the cover.

21. A modular platen assembly for use with a variety of containers, the modular platen assembly comprising:

a hub comprising:

an axial collar for connecting to a ram of an inductor pump; and a radial flange extending from the axial collar;

a coupling ring connected to the radial flange at a first connection and extending radially outward beyond the radial flange; and a wiper ring assembly connected to the coupling ring at a second connection independent of the first connection, the wiper ring assembly comprising:

a wiper connected to the coupling ring at the second connection; and a wiper plate coupled to the coupling ring at the second connection, wherein the wiper is positioned axially between the wiper plate and the coupling ring; and a secondary wiper positioned axially between the annular wiper and the coupling ring, the secondary wiper having an outer radial end positioned between an outer radial end of the wiper and an outer radial end of the coupling ring.

* * * * *